US010196074B2

(12) United States Patent
Huck

(10) Patent No.: US 10,196,074 B2
(45) Date of Patent: Feb. 5, 2019

(54) RAILCAR SAFETY APPLIANCES

(71) Applicant: Trinity Rail Group, LLC, Dallas, TX (US)

(72) Inventor: Kenneth W. Huck, Fairview, TX (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 0 days.

(21) Appl. No.: 15/583,614

(22) Filed: May 1, 2017

(65) Prior Publication Data

US 2017/0327132 A1 Nov. 16, 2017

Related U.S. Application Data

(60) Provisional application No. 62/335,481, filed on May 12, 2016.

(51) Int. Cl.

| | |
|---|---|
| ***B61D 3/00*** | (2006.01) |
| ***B61D 47/00*** | (2006.01) |
| ***B61D 23/00*** | (2006.01) |
| ***B61D 3/18*** | (2006.01) |

(52) U.S. Cl.

CPC ..... *B61D 47/00* (2013.01); *B61D 3/00* (2013.01); *B61D 3/184* (2013.01); *B61D 23/00* (2013.01)

(58) Field of Classification Search

CPC ..... B61D 3/12; B61D 49/00; B61D 23/00; B61D 3/00; B61D 47/00

USPC ..... 105/355, 457, 422, 425

See application file for complete search history.

(56) References Cited

U.S. PATENT DOCUMENTS

| | | | | |
|---|---|---|---|---|
| 1,130,296 A * | 3/1915 | Jones | B62D 31/02 | 105/341 |
| 1,172,563 A * | 2/1916 | Rowntree | B61D 13/00 | 105/341 |
| 5,423,269 A * | 6/1995 | Saxton | B61D 3/184 | 105/355 |
| 8,950,341 B2 * | 2/2015 | Boring | B61D 3/20 | 105/355 |
| 2009/0090266 A1 * | 4/2009 | Pujol | A61G 3/066 | 104/31 |

* cited by examiner

*Primary Examiner* — Mark T Le

(74) *Attorney, Agent, or Firm* — Baker Botts, LLP

(57) ABSTRACT

According to some embodiments, a railcar comprises a pair of trucks near each end of the railcar, and a well component supported by and disposed between the trucks. The well component comprises two parallel top chords. A pair of end sections are supported by the trucks and disposed at each end of the railcar. At least one end section comprises a pair of running boards. Each running board is disposed on one of the top chords of the well component. The end section further comprises a well platform disposed near an end of the well component at a first height generally even with the pair of running boards and an end platform disposed near one end of the railcar at a second height. The second height is lower than the first height. The end section also comprises an inclined connecting platform extending between the end platform and the well platform.

17 Claims, 12 Drawing Sheets

RAILCAR SAFETY APPLIANCES

RELATED APPLICATION

This application claims priority to U.S. Provisional Application Ser. No. 62/335,481, entitled "INTERMODAL RAILCAR WALKWAYS," filed May 12, 2016.

TECHNICAL FIELD OF THE INVENTION

This disclosure generally relates to railroad cars, and more particularly to railcar safety appliances such as handrails, handholds, steps, and walkways.

BACKGROUND

Railcar safety appliances include handholds, ladders, steps, platforms, walkways, handrails, etc. that serve as an interface between rail operators and railcars. Various types of railcars (e.g., flatcars, boxcars, intermodal well cars, tank cars, hopper cars, etc.) include various configurations of safety appliances.

As one example of a railcar, an intermodal well car is a type of railroad car designed to transport intermodal containers (shipping containers). An intermodal container is a standardized (length, width, etc.) container for transporting freight using multiple modes of transportation (e.g., rail, ship, truck, etc.). The well of the intermodal well car creates a floor lower than a traditional flatcar. The recessed well facilitates stacking of two intermodal containers (double-stack) without exceeding height limitations for safe passage under bridges, through tunnels, and other structures.

The stacked intermodal containers may be secured to each other through the use of a bulkhead or with inter-box connectors. When loading and unloading intermodal containers using inter-box connectors, rail operators access the inter-box connectors typically located at the four corners of the container. The connection points, however, are too high for a rail operator to access while standing on the ground. Thus, intermodal well cars typically include steps, ladders, walkways, walkways, etc. at each end of the railcar so that the rail operator may access the connection points on the containers. A rail operator may also need to access the recessed well of the intermodal railcar.

Other types of railcars may include ladders or steps for accessing various parts of the railcar. For example, tank cars and hopper cars may include end ladders that provide access to a top walkway or top platform.

SUMMARY

According to some embodiments, a railcar comprises a pair of trucks disposed near each end of the railcar, and a well component supported by the pair of trucks and disposed between the pair of trucks. The well component comprises two parallel top chords. A pair of end sections is supported by the pair of trucks and disposed at each end of the railcar. At least one end section comprises a pair of walkways. Each walkway of the pair of walkways is disposed on one of the two parallel top chords of the well component. At least one end section further comprises a well platform disposed near an end of the well at a first height generally even with the pair of walkways and an end platform disposed near one end of the railcar at a second height. The second height is lower than the first height. The at least one end section further comprises a first inclined connecting platform extending between the end platform and the well platform. The first height may be one inch or less different than the second height. Particular embodiments may include a second inclined connecting platform extending between the end platform and the well platform, or a ladder coupled to the end platform.

In particular embodiments, the end platform comprises an intermediate end platform at the second height and two edge end platforms at a third height. The third height is lower than the second height. The end platform further comprises two inclined end platforms. Each inclined end platform extends between one of the edge end platforms and the intermediate end platform. The first inclined connecting platform extends between the intermediate end platform and the well platform.

In particular embodiments, the well platform comprises an intermediate well platform at a fourth height. The fourth height is lower than the first height. The well platform further comprises two edge well platforms at the first height and two inclined well platforms. Each inclined well platform extends between one of the edge well platforms and the intermediate well platform. The first inclined connecting platform extends between the end platform and the intermediate well platform.

According to some embodiments, railcar end section comprises a first platform disposed at a first height for providing operator access to a portion of the railcar. The first platform is oriented to facilitate operator movement in a transverse direction across the railcar. The end section comprises a second platform disposed at a second height. The second height is different than the first height. The second platform is oriented to facilitate operator movement in a transverse direction across the railcar. The end section also comprises a first inclined connecting platform extending between the first platform and the second platform. The inclined platform is oriented to facilitate operator movement in a longitudinal direction along the railcar. The first height may be one inch or less different than the second height. Particular embodiments may include a second inclined connecting platform extending between the first platform and the second platform, or a ladder coupled to the second platform. The railcar may comprise a well car and the first platform may provide operator access to a well component of the well car.

In particular embodiments, the first platform comprises a first intermediate platform at a fourth height. The fourth height is lower than the first height. The first platform also comprises two first edge platforms at the first height and two first inclined platforms. Each first inclined platform extends between one of the first edge platforms and the first intermediate platform. The first inclined connecting platform extends between the first intermediate platform and the second platform.

In particular embodiments, the second platform comprises a second intermediate platform at the second height and two second edge platforms at a third height. The third height is lower than the second height. The end section also includes two second inclined platforms. Each second inclined platform extends between one of the second edge platforms and the second intermediate platform. The first inclined connecting platform extends between the first platform and the second intermediate platform.

According to some embodiments, a platform system for use with a railcar comprises a first platform disposed at a first height for providing operator access to a portion of a railcar and a second platform oriented generally parallel to the first platform and disposed at a second height. The second height is different than the first height. The platform system also includes a first inclined connecting platform extending between the first platform and the second platform. The inclined platform is oriented to facilitate operator movement between the first platform and the second platform.

According to some embodiments, a railcar comprises a pair of trucks disposed near each end of the railcar and a well component disposed between the pair of trucks. A pair of end sections is supported by the pair of trucks and disposed at each end of the railcar. At least one end section comprises one or more platforms providing access to the well component, and one or more handrails partially enclosing at least one of the one or more platforms.

In particular embodiments, the one or more platforms providing access to the well component comprise: a well platform disposed near an end of the well component; an end platform disposed near an end of the railcar; and a connecting platform extending between the end platform and the well platform. The one or more handrails extending along an edge of at least one of the end platform, the connecting platform, and the well platform.

In particular embodiments, the railcar further comprises a pair of ladders, each ladder of the pair of ladders coupled to an end of the end platform. The one or more handrails include a handrail extending between the pair of ladders and along an outside edge of the end platform perpendicular to a longitudinal axis of the railcar and adjacent to the end of the railcar. Another handrail may extend from a ladder of the pair of ladders and along the inside edge of the end platform perpendicular to the longitudinal axis of the railcar, along an edge of the connecting platform parallel to the longitudinal axis of the railcar, and along an inside edge of the well platform perpendicular to the longitudinal axis of the railcar. Supports may couple the handrail to the connecting platform and the well platform. Another handrail may extend along an edge of the well platform perpendicular to the longitudinal axis of the railcar and adjacent to the well component.

In particular embodiments, the one or more platforms providing access to the well component comprise an end platform disposed near an articulated end of the railcar. The one or more handrails include a pair of handrails extending along an outside edge of the end platform perpendicular to the longitudinal axis of the railcar and adjacent to the articulated end of the railcar. The pair of handrails are separated by an opening forming a passageway for an operator to pass between the pair of handrails to access an adjacent articulated railcar. Another handrail may extend along an edge of the end platform adjacent to the well component of the railcar.

According to some embodiments, a handrail system for a railcar comprises one or more handrails partially enclosing at least one or more platforms of a railcar. The railcar comprises a pair of end sections disposed at each end of the railcar, and a well component disposed between the pair of end sections. At least one end section comprises the at least one or more platforms providing an operator access to the well component.

In particular embodiments, the one or more platforms providing an operator access to the well component comprise: a well platform disposed near an end of the well component; an end platform disposed near an end of the railcar; and a connecting platform extending between the end platform and the well platform. The one or more handrails extend along an edge of at least one of the end platform, the connecting platform, or the well platform.

In particular embodiments, the railcar further comprises a pair of ladders. Each ladder of the pair of ladders is coupled to an end of the end platform. The one or more handrails include a handrail extending between the pair of ladders and along an outside edge of the end platform perpendicular to the longitudinal axis of the railcar and adjacent to the end of the railcar. Another handrail may extend from a ladder of the pair of ladders and along an inside edge of the end platform perpendicular to the longitudinal axis of the railcar and adjacent an interior portion of the railcar, along an edge of the connecting platform parallel to the longitudinal axis of the railcar, and along an inside edge of the well platform perpendicular to the longitudinal axis of the railcar. Supports may couple the handrail to the connecting platform and the well platform. Another handrail may extend along an edge of the well platform perpendicular to the longitudinal axis of the railcar and adjacent to the well component.

In particular embodiments, the one or more platforms providing access to the well component comprise an end platform disposed near an articulated end of the railcar. The one or more handrails include a pair of handrails extending along an outside edge of the end platform perpendicular to the longitudinal axis of the railcar and adjacent to the articulated end of the railcar. The pair of handrails are separated by an opening forming a passageway for an operator to pass between the pair of handrails to access an adjacent railcar. Another handrail may extend along an edge of the end platform perpendicular to the longitudinal axis of the railcar and adjacent to the well component of the railcar.

According to some embodiments, a railcar comprises a pair of trucks disposed near each end of the railcar and a well component disposed between the pair of trucks. A pair of end sections are disposed at each end of the railcar. A first end section of the pair of end sections comprises: a well platform disposed near an end of the well component; a first end platform disposed near an end of the railcar; and a connecting platform extending between the first end platform and the well platform. The railcar further comprises a pair of ladders. Each ladder of the pair of ladders is coupled to an end of the first end platform. A first handrail extends between the pair of ladders and along an outside edge of the first end platform perpendicular to the longitudinal axis of the railcar and adjacent to the end of the railcar. A second handrail extending from a ladder of the pair of ladders and along an inside edge of the first end platform perpendicular to the longitudinal axis of the railcar and adjacent an interior portion of the railcar, along an edge of the connecting platform parallel to the longitudinal axis of the railcar, and along an inside edge of the well platform perpendicular to the longitudinal axis of the railcar. A third handrail extends along an edge of the well platform perpendicular to the longitudinal axis of the railcar and adjacent to the well component.

In particular embodiments, a second end section of the pair of end sections comprising a second end platform disposed near an articulated end of the railcar. A pair of handrails extend along an outside edge of the second end platform perpendicular to the longitudinal axis of the railcar and adjacent to the articulated end of the railcar. The pair of handrails are separated by an opening forming a passageway for an operator to pass between the pair of handrails to access an adjacent articulated railcar.

According to some embodiments, a railcar comprises a pair of trucks disposed near each end of the railcar. A well component is supported by the pair of trucks and disposed between the pair of trucks. A pair of end sections are supported by the pair of trucks and disposed at each end of the railcar. At least one end section of the pair of end sections comprises: a well platform disposed near an end of the well;

a step coupled to the at least one end section and extending into the well component to facilitate operator egress from the well component to the well platform; and a first handrail proximate the step.

In particular embodiments, the step comprises a first horizontal ladder rung and the first handrail comprises a second horizontal ladder rung positioned above the first horizontal ladder rung. The step may comprise a first horizontal ladder rung, the first handrail may comprise a first vertical ladder rail, and a second handrail may comprise a second vertical ladder rail.

In particular embodiments, the first handrail is positioned above the step and positioned below the well platform. The step may comprise a substantially flat surface, and the handrail may comprise a substantially rounded surface. The step may comprise angled bar. The step may be coupled to the well platform via a pair of ladder rails. The ladder rails may comprise angled bar. The handrail may comprise round bar coupled between the pair of ladder rails.

According to some embodiments, a ladder system for facilitating operator egress from a well component of a railcar comprises a step and a handrail. The railcar comprises a pair of end sections disposed at each end of the railcar. The well component is disposed between the pair of end sections. At least one end section of the pair of end sections comprises a well platform disposed near an end of the well. When the ladder system is coupled to the at least one end section, the step and handrail are disposed within the well component to facilitate operator egress from the well component to the well platform.

In particular embodiments, the step comprises a first horizontal ladder rung and the handrail comprises a second horizontal ladder rung positioned above the first horizontal ladder rung. The step may comprise a first horizontal ladder rung, and the handrail may comprise a pair of vertical ladder rails. The first handrail may be positioned above the step and positioned below the well platform when the ladder system is coupled to the at least one end section.

In particular embodiments, the step comprises a substantially flat surface, and the handrail comprises a substantially rounded surface. The step may comprise angled bar coupled between a pair of ladder rails. The ladder rails may comprise angled bar. The handrail may comprise round bar coupled between the pair of ladder rails.

According to some embodiments, a handrail system for facilitating operator egress from a well component of a railcar comprises a handrail. The railcar comprises a pair of end sections disposed at each end of the railcar. The well component is disposed between the pair of end sections. At least one end section of the pair of end sections comprises a well platform disposed near an end of the well. A step extends into the well component to facilitate operator egress from the well component to the well platform. The handrail is positioned above the step and below the well platform.

In particular embodiments, the step comprises a first horizontal ladder rung and the handrail comprises a second horizontal ladder rung positioned above the first horizontal ladder rung. The step may comprise a first horizontal ladder rung, and the handrail may comprise a pair of vertical ladder rails.

In particular embodiments, the step comprises a substantially flat surface, and the handrail comprises a substantially rounded surface. The step may comprise angled bar coupled between a pair of ladder rails. The ladder rails may comprise angled bar. The handrail may comprise round bar coupled between the pair of ladder rails.

As a result, particular embodiments of the present disclosure may provide numerous technical advantages. For example, a rail operator may access platforms of varying height via inclined walkways without the tripping risk inherent with steps. Various handrails may provide support for an operator traversing an end of a railcar and prevent the operator from intentionally or accidentally accessing portions of the railcar other than designated walkways or platforms. Staggered handrails may provide ergonomically improved support for an operator traversing a staggered ladder. Handrails within a well of a railcar may improve operator egress from the well. Particular embodiments of the present disclosure may provide some, none, all, or additional technical advantages.

BRIEF DESCRIPTION OF THE DRAWINGS

A more complete and thorough understanding of the particular embodiments and advantages thereof may be acquired by referring to the following description taken in conjunction with the accompanying drawings, in which like reference numbers indicate like features, and wherein.

DETAILED DESCRIPTION

Railcars include various configurations of safety appliances (e.g., handholds, walkways, ladders, platforms, steps, handrails, etc.). For example, an end section of an intermodal well car may include various ladders, steps, and platforms of various heights. The varying heights may pose a trip and fall hazard for rail operators.

Particular embodiments obviate the problems described above and include an intermodal well car with various platform and handrail configurations. Particular embodiments enable a rail operator access to traverse the railcar without the dangers associated with conventional end sections. For example, particular embodiments include an intermodal well car end section with platforms of various heights connected via inclined platforms. Particular embodiments include improved handrail configurations. Some embodiments include hand holds to improve operator ingress/egress to/from the well section of an intermodal well car.

Particular embodiments of the invention and its advantages are best understood by reference to FIGS. 1 through 11B, wherein like reference numbers indicate like features.

Figure 1:
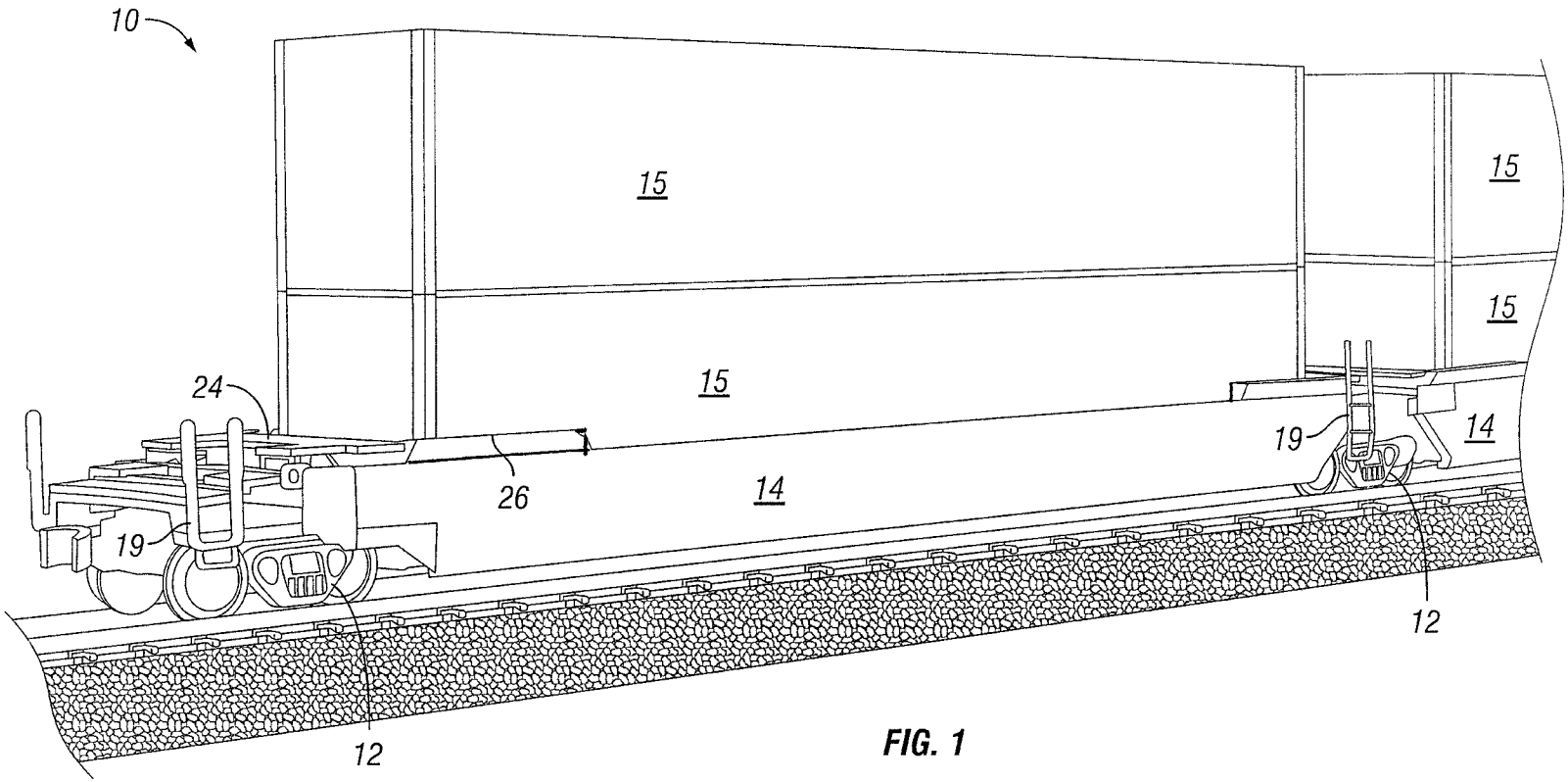
FIG. 1 is a perspective schematic of an example well car with intermodal containers.

FIG. 1 is a perspective schematic of an example well car with intermodal containers. Railcar 10 includes a pair of conventional trucks 12. Trucks 12 support well 14, which extends between trucks 12. Well 14 includes a recessed well for transporting containers 15, such as intermodal containers (e.g., 53', 48', 45', 20' containers, etc.). Well 14 transports the containers lower (i.e., closer to the rails) than a traditional flatcar. Thus, railcar 10 may transport containers 15 in a stacked configuration with one container 15 stacked on top of another container 15 (i.e., double-stack transport), as illustrated. Well 14 reduces the risk of the stacked containers encountering clearance problems. Well 14 also lowers the center of gravity of railcar 10 compared to a traditional flatcar. Well 14 may also be referred to as well component 14.

In some embodiments, railcar 10 comprises an articulated railcar. An articulated railcar comprises multiple wells 14 (e.g., two to five wells 14). Wells 14 may be connected via a single truck between wells 14.

Stacked intermodal containers 15 may be secured to well 14 and to each other through the use of a bulkhead or with inter-box connectors. When loading and unloading intermodal containers 15, a rail operator needs access to the inter-box connectors typically located at the four corners of container 15. The connection points, however, are too high for a rail operator to access while standing on the ground. Thus, intermodal well cars typically include handholds, walkways, ladders, platforms, steps, handrails, etc. at each end of the railcar so that the rail operator may access the connection points on the containers.

For example, railcar 10 includes ladders 19 that a rail operator may use to access an end section of railcar 10. The end section may include well platform 24 near an end of well 14 providing a walking surface for a rail operator to access containers 15. The end section may include walkways 26. Walkway 26 may extend from well platform 24 along one side of well 14, providing a walking surface for a rail operator to access the sides of containers 15. In some embodiments, well platform 24 and walkways 26 are generally the same height (i.e., the same height or within a few inches of each other).

Figure 2:
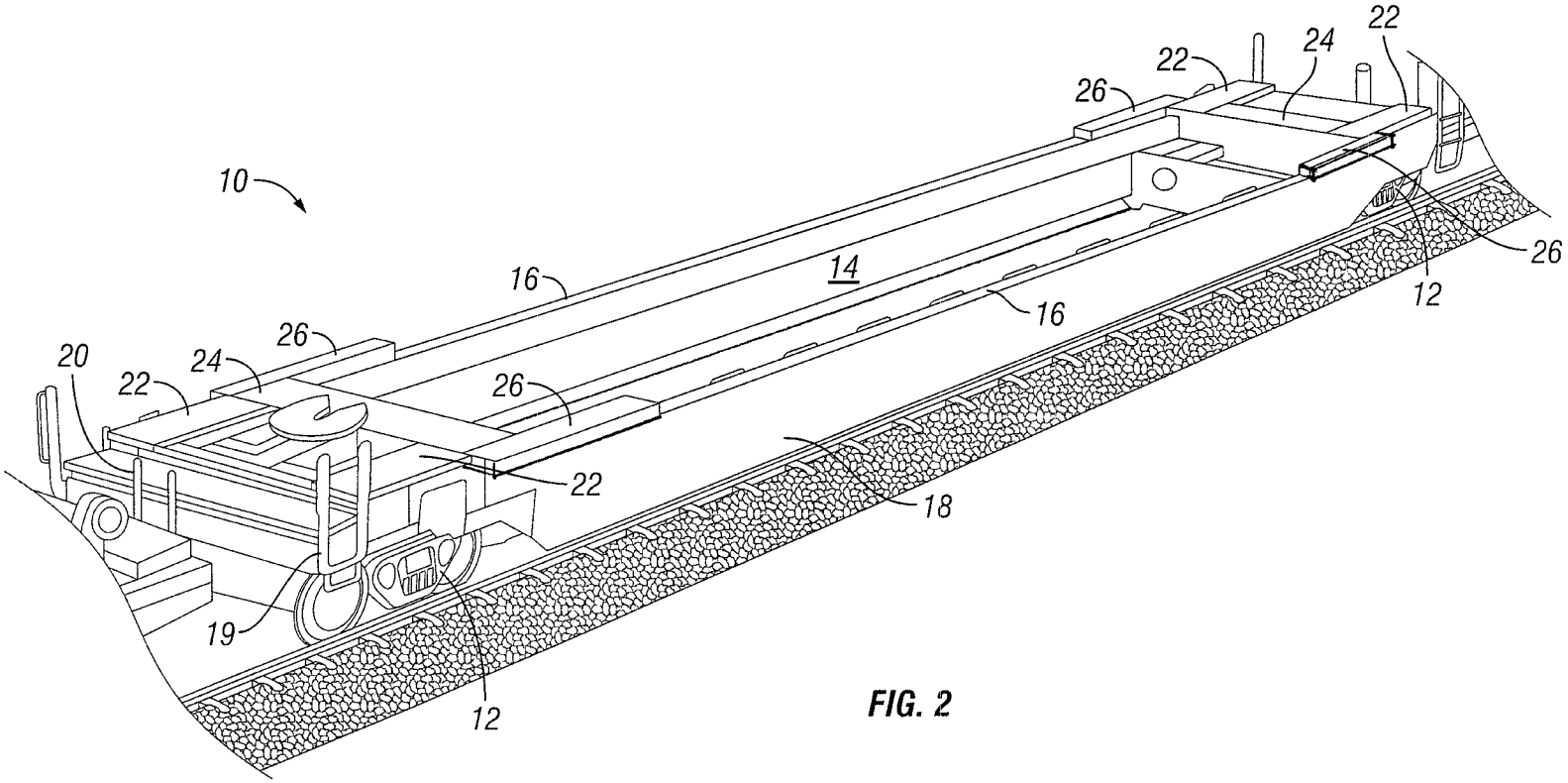
FIG. 2 is a perspective schematic of an example well car without intermodal containers.

FIG. 2 is a perspective schematic of an example well car without intermodal containers. Railcar 10 includes a pair of conventional trucks 12. Trucks 12 support well 14, which extends between trucks 12. Well 14 comprises top chords 16 and side sills 18. Top chords 16 typically comprise steel tube box sections and side sills 18 typically comprise angled steel sections. Well 14 is sized to accommodate standard sized intermodal shipping containers or trailers.

The typical well car includes two end sections each supported by trucks 12 at each end of well 14. Each end section includes various handholds, walkways, ladders, platforms, steps, handrails, etc. for a rail operator to access the intermodal containers. For example, a typical end section may include ladders 19, end platform 20, connecting platforms 22 extending form end platform 20 to well platform 24, and walkways 26 extending from well platform 24 along both sides of well 14 and supported by top chords 16.

A rail operator may access the end section using ladder 19 to access end platform 20. The operator may step up to one of connecting platforms 22 to access well platform 24 and walkways 26. The various platforms typically comprise a non-slip and self-cleaning decking surface, such as a metal diamond mesh or other suitable decking. The platforms are generally between 18 inches and 24 inches in width.

Figure 3:
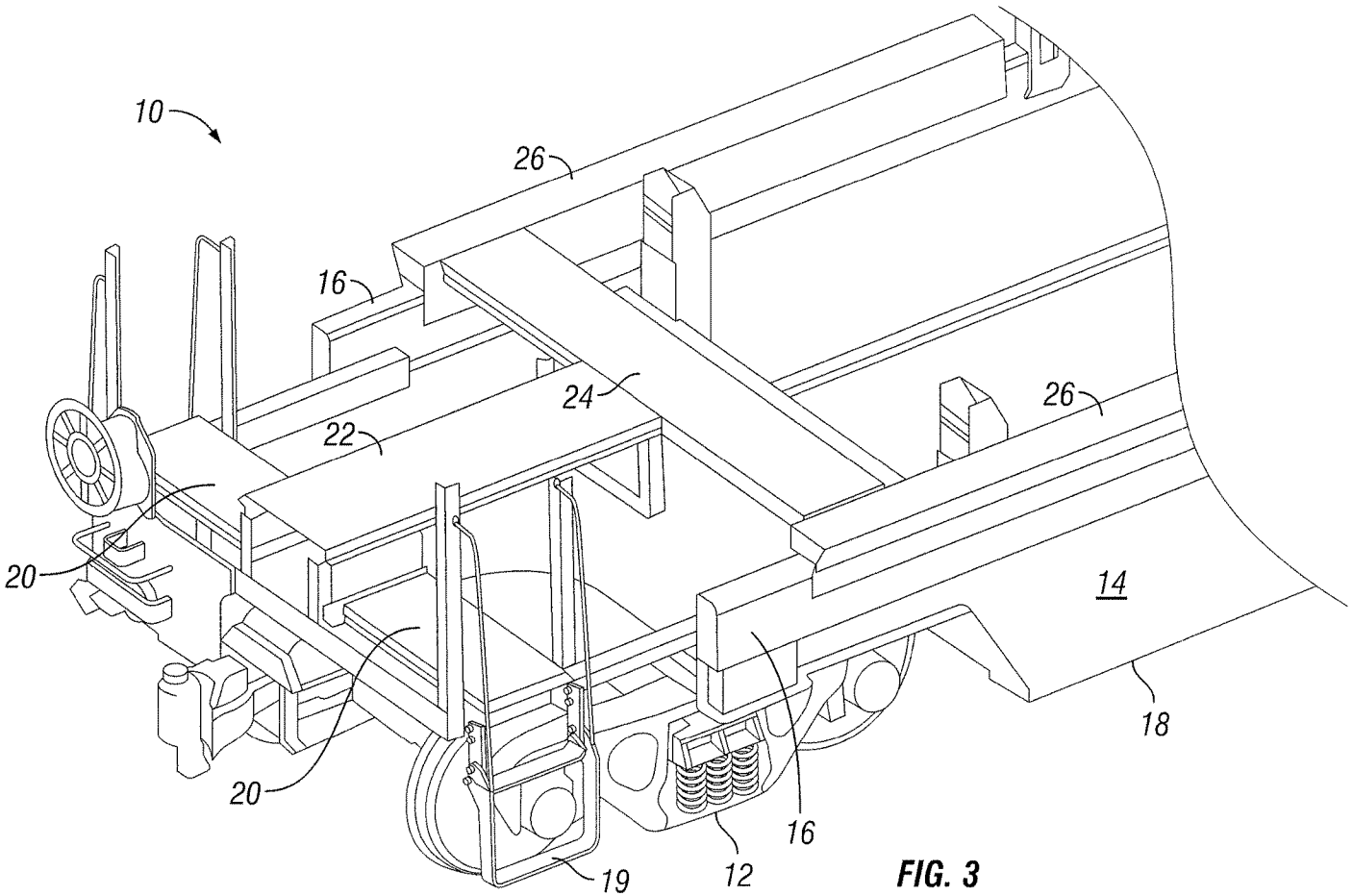
FIG. 3 is a perspective schematic of one end of an example well car.

FIG. 3 is a perspective schematic of one end of an example well car, according to some embodiments. FIG. 3 illustrates one end of a railcar similar to railcar 10 described with respect to FIGS. 1 and 2.

In the illustrated example, railcar 10 includes two end platforms 20 and a single connecting platform 22 extending from end platforms 20 to well platform 24. A rail operator may access the end section using ladder 19 to access one of end platforms 20. The operator may step up to connecting platform 22 to access well platform 24 and walkways 26.

The varying heights of the different platforms illustrated in FIGS. 1-3 can pose a safety hazard for the rail operator. For example, steps between levels (e.g., between end platform 20 and connecting platform 22) are often of uneven size or height, creating a potential trip and fall danger for the rail operator navigating the walkways.

One proposed solution locates all the walkways in a single plane. For example, walkways 26, well platform 24, connecting platform 22, and end platform 20 may all be co-planar at one height, such as the height of walkways 26. This solution, however, extends the height of ladder 19, which requires the rail operator to climb additional ladder rungs. Climbing the additional ladder rungs may be as dangerous as the uneven steps when climbing in inclement weather, or when climbing with tools in hand.

The embodiments described herein include an intermodal well car end section with platforms of various heights connected via inclined platforms. The inclined platforms provide a safer transition between platforms than conventional steps. Particular embodiments provide a rail operator access to the intermodal containers without the dangers (e.g., uneven steps or tall ladders) associated with conventional end sections.

Figure 4:
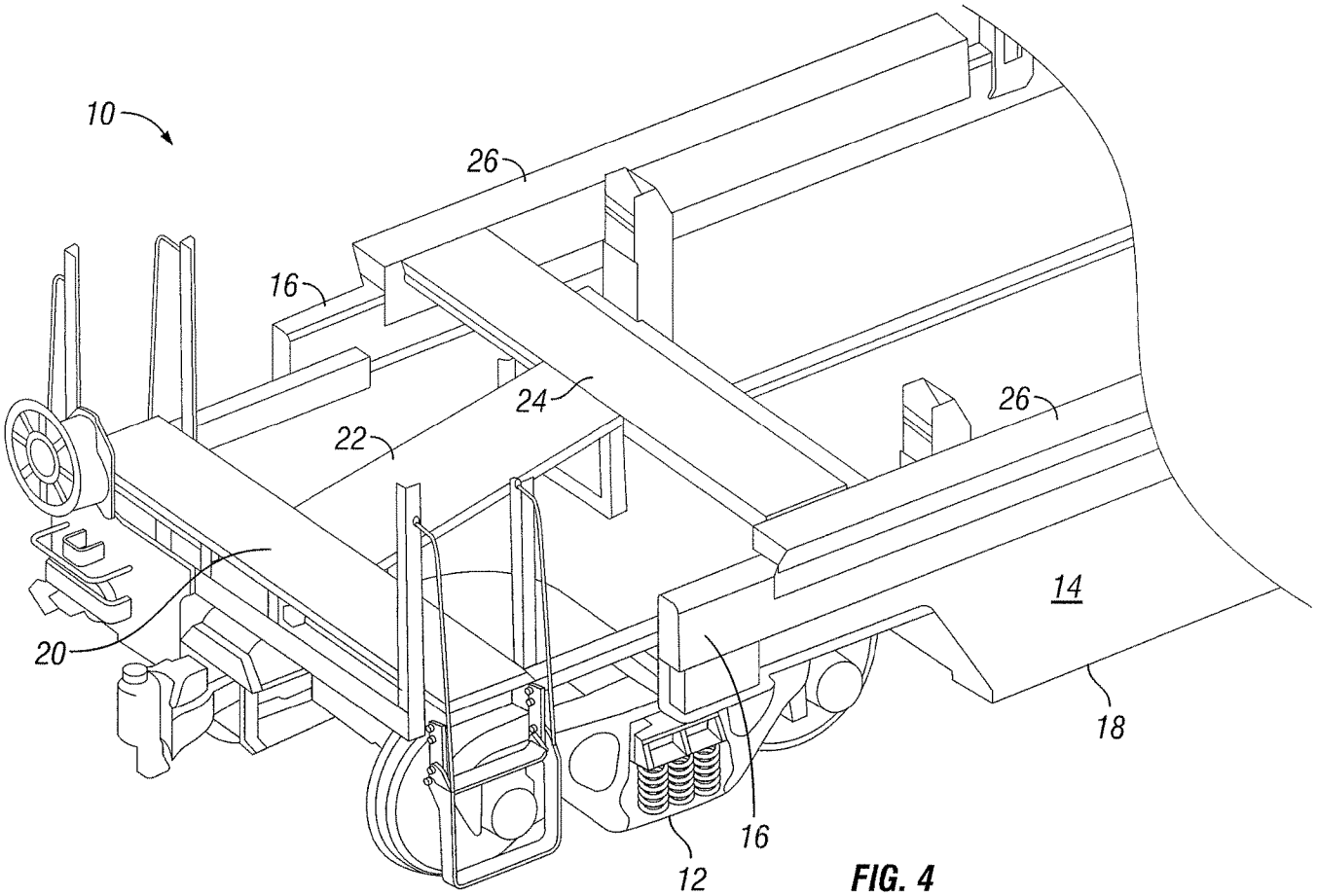
FIG. 4 is a perspective schematic of one end of an example well car with an inclined platform, according to some embodiments.

FIG. 4 is a perspective schematic of one end of an example well car with an inclined platform, according to some embodiments. Railcar 10 includes an end section and a well component similar to railcar 10 described with respect to FIGS. 1-3.

According to some embodiments, each end section of railcar 10 may include ladders 19, end platform 20, inclined connecting platform 22 extending from end platform 20 to well platform 24, and walkways 26 extending from well platform 24 along both sides of well 14 and supported by top chords 16.

Well platform 24 is oriented to facilitate operator movement in a transverse direction across railcar 10. End platform 20 is generally parallel to well platform 24 and also facilitates operator movement in a transverse direction across railcar 10. Inclined connecting platform 22 facilitates operator movement in a longitudinal direction along railcar 10 between end platform 22 and well platform 24.

A rail operator may access the end section using ladder 19 to access end platform 20. The operator may walk up inclined connecting platform 22 to access well platform 24 and walkways 26. End platform 20, inclined connecting platform 22, well platform 24, and walkways 26 may comprise a non-slip and self-cleaning decking surface, such as a metal diamond mesh or any other suitable material. A particular benefit of the illustrated embodiment is that inclined connecting platform 22 replaces one or more steps, such as the step between end platform 20 and connecting platform 22 illustrated in FIGS. 1-3.

Although end platform 20 and well platform 24 are illustrated at particular heights, particular embodiments may locate end platform 20 and well platform 24 at any suitable height. For example, in particular embodiments end platform 20 may be raised to within less than one inch of well platform 24.

Figure 5B:
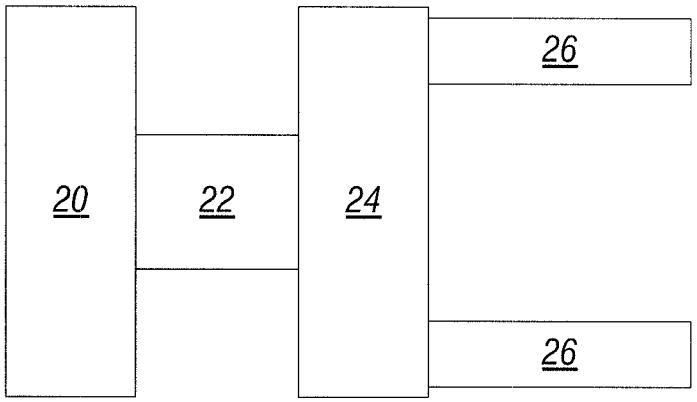
FIG. 5B is an overhead schematic of an example end section, according to a particular embodiment.
Figure 5C:
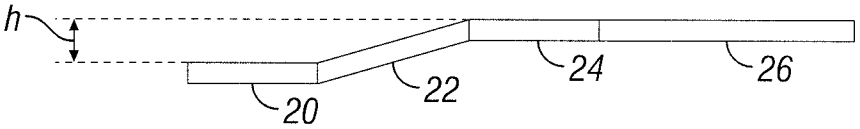
FIG. 5C is a side schematic of an example end section, according to a particular embodiment.
Figure 5A:
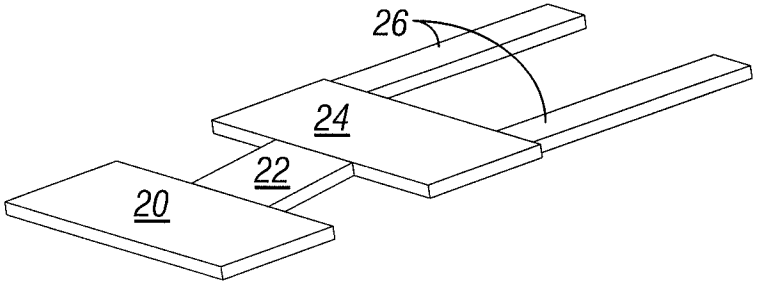
FIG. 5A is a perspective schematic of an example end section, according to a particular embodiment.

FIG. 5A is a perspective schematic of an example end section, according to a particular embodiment. FIG. 5A is an isolated view of end platform 20, inclined connecting platform 22, well platform 24, and walkways 26 illustrated in FIG. 4. As illustrated, in particular embodiments end platform 20 and well platform 24 are of different height and are connected via inclined connecting platform 22.

FIG. 5B is an overhead schematic of an example end section, according to a particular embodiment. FIG. 5B is an isolated view of end platform 20, inclined connecting platform 22, well platform 24, and walkways 26 illustrated in FIG. 4.

Although the illustrated embodiment includes a single inclined connecting platform 22, particular embodiments may include any suitable number of inclined connecting platforms extending between end platform 20 and well platform 24. For example, instead of one center inclined connecting platform, particular embodiments may include two inclined connecting platforms, one on each side of the well car.

FIG. 5C is a side schematic of an example end section, according to a particular embodiment. FIG. 5C is an isolated view of end platform 20, inclined connecting platform 22, well platform 24, and walkways 26 illustrated in FIG. 4. Arrow h indicates the height difference between end platform 20 and well platform 24. In particular embodiments, h may be less than one inch. In other embodiments, h may be greater than one inch (e.g., up to one or more feet).

In particular embodiments, the slope of inclined connecting platform 22 may comprise a 1 percent slope. In other embodiments, inclined connecting platform 22 may comprise any suitable slope to connect end platform 20 to well platform 24.

Although FIGS. 4-5C illustrate a particular end section configuration, other embodiments may include any suitable configuration of platforms and inclined connecting platforms. For example, FIGS. 6A-6D illustrate another example end section.

Figure 6B:
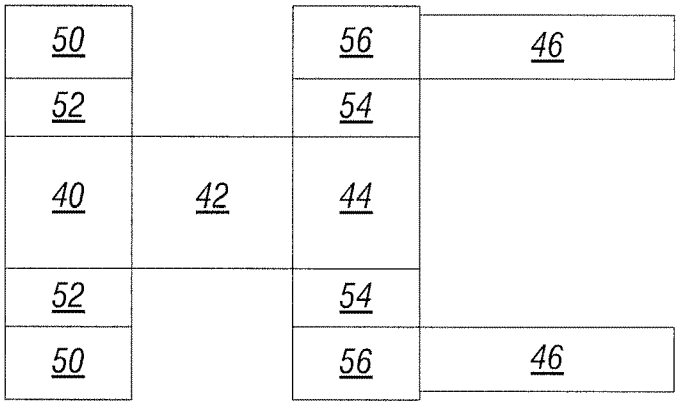
FIG. 6B is an overhead schematic of another example end section, according to a particular embodiment.
Figure 6D:
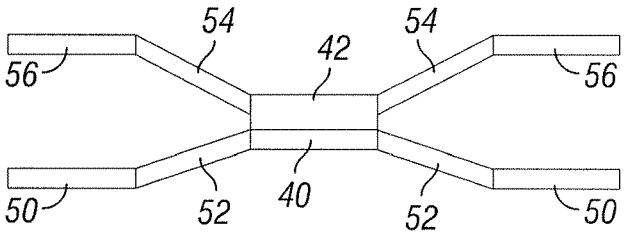
FIG. 6D is an end schematic of another example end section, according to a particular embodiment.
Figure 6A:
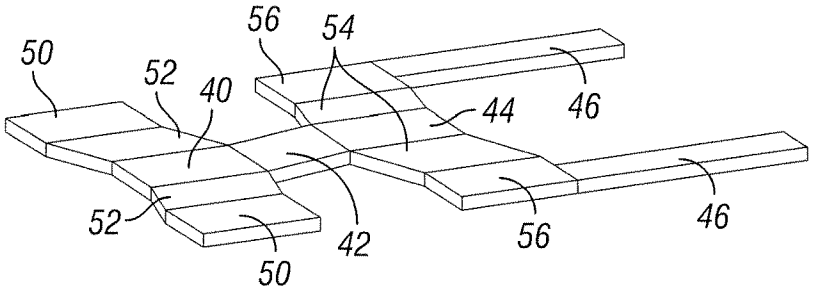
FIG. 6A is a perspective schematic of another example end section, according to a particular embodiment.

FIG. 6A is a perspective schematic of another example end section, according to a particular embodiment. For simplicity, the components illustrated in FIG. 6A are shown isolated from an intermodal well car, such as railcar 10 illustrated in FIG. 4.

An end platform comprises edge end platforms 50, inclined end platforms 52, and intermediate end platform 40. Inclined end platforms 52 extend between edge end platforms 50 and intermediate end platform 40. Inclined connecting platform 42 extends from the end platform, particularly intermediate end platform 40, to a well platform, particularly intermediate well platform 44.

The well platform comprises intermediate well platform 44, inclined well platforms 54, and edge well platforms 56. Inclined well platforms 54 extend between intermediate well platform 44 and edge well platforms 56. Walkways 46 extend from edge well platforms 56 along each side of the well, such as well 14 illustrated in FIG. 4.

A particular benefit of the embodiment illustrated in FIG. 6A is that the height difference between edge end platforms 50 and edge well platforms 56 is traversed by multiple inclined connecting platforms (i.e., inclined end platforms 52, inclined connecting platform 42, and inclined well platforms 54) instead of a single inclined connecting platform, such as inclined connecting platform 22 illustrated in FIG. 5A. Thus, embodiments such as those described with respect to FIG. 5A may provide advantages when the height difference between the end platform and the well platform is relatively small. Embodiments such as those described with respect to FIG. 6A may provide advantages for larger height differences between the end platform and the well platform.

FIG. 6B is an overhead schematic of another example end section, according to a particular embodiment. FIG. 6B is an overhead view of the similarly numbered components illustrated in FIG. 6A. Although the illustrated embodiment includes multiple inclined platforms (e.g., inclined end platforms 52) on the end platform and multiple inclined platforms (e.g., inclined well platforms 54) on the well platform, other embodiments may include any combinations of the components described with respect to FIGS. 5A and 6A or any suitable combination of inclined platforms.

For example, particular combinations may include a single end platform and a well platform with multiple inclined platforms or a single well platform and an end platform with multiple inclined platforms. As another example, in some embodiments intermediate end platform 40 may be the same height as intermediate well platform 44 and the platform extending between them may not be inclined. As another example, particular embodiments may not include edge end platforms 50, and inclined end platforms 52 may extend towards an edge of the end section.

Figure 6C:
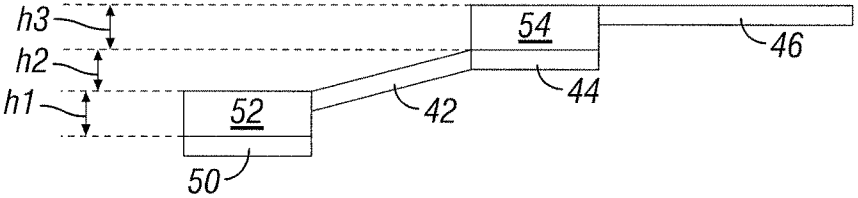
FIG. 6C is a side schematic of another example end section, according to a particular embodiment.

FIG. 6C is a side schematic of another example end section, according to a particular embodiment. FIG. 6C is a side view of the similarly numbered components illustrated in FIG. 6A. Arrow h1 indicates the height between edge end platform 50 and intermediate end platform 40. Arrow h2 indicates the height between intermediate end platform 40 and intermediate well platform 44. Arrow h3 indicates the height between intermediate well platform 44 and edge well platform 56. In particular embodiments, any of h1, h2, and h3 may vary from less than one inch to a foot or more. In particular embodiments any of h1, h2, and h3 may comprise any suitable height for extending between end components of an intermodal well car.

FIG. 6D is an end schematic of another example end section, according to a particular embodiment. FIG. 6D is an end view of the similarly numbered components illustrated in FIG. 6A. As illustrated by the various examples, particular embodiments enable a rail operator to access platforms of varying height via inclined walkways without the tripping risk inherent with steps.

Figure 8:
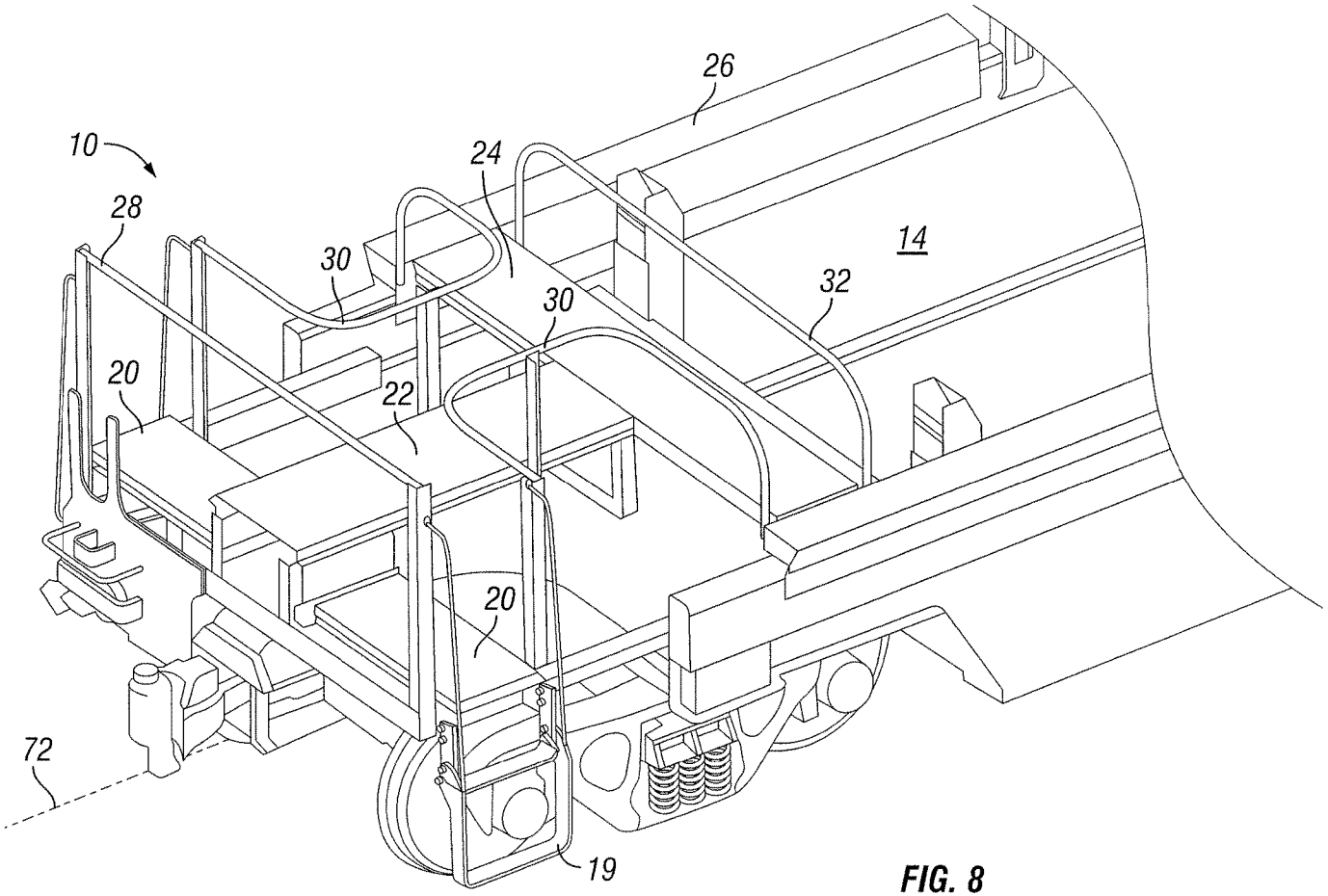
FIG. 8 is a perspective schematic of one end of an example well car with multiple handrails, according to a particular embodiment.
Figure 9:
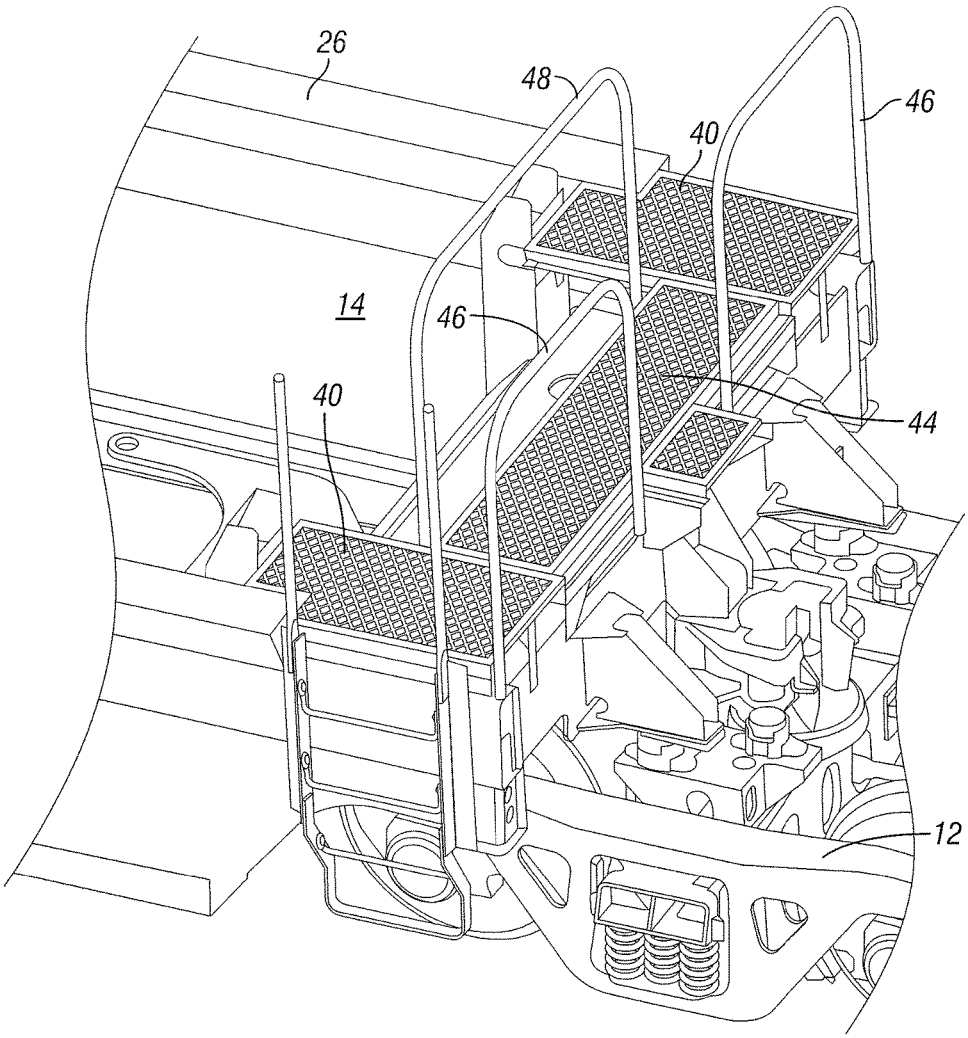
FIG. 9 is a perspective schematic of an articulated end of an example articulated well car with handrails, according to a particular embodiment.

Further safety advantages may be realized through various handrail configurations. Examples are illustrated in FIGS. 7-9.

Figure 7:
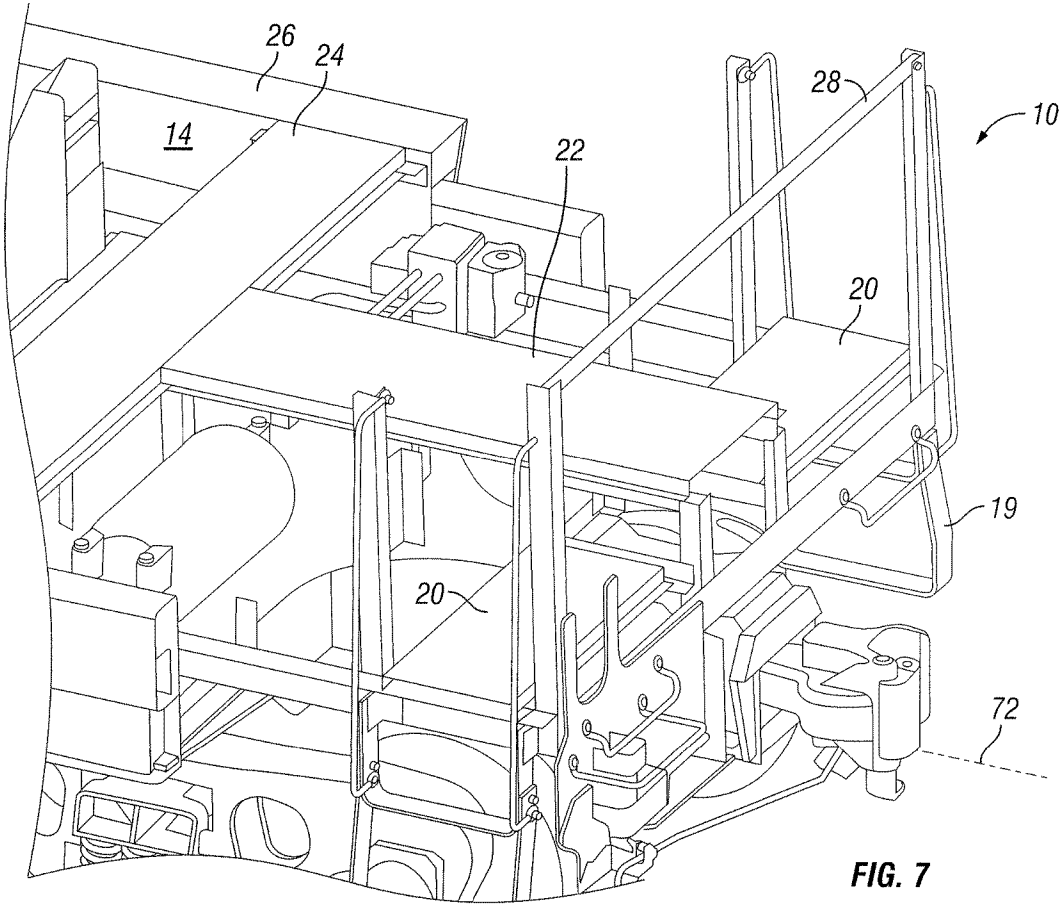
FIG. 7 is a perspective schematic of one end of an example well car with a handrail, according to a particular embodiment.

FIG. 7 is a perspective schematic of one end of an example well car with a handrail, according to a particular embodiment. FIG. 7 illustrates one end of a railcar similar to railcar 10 described with respect to FIGS. 3 and 4.

In particular embodiments, handrail 28 extends along an outside edge of end platform 20. The outside edge of end platform 20 refers to the edge adjacent to the end of the railcar. Handrail 28 is generally perpendicular to longitudinal axis 72 of railcar 10.

In some embodiments, handrail 28 extends between ladders 19. Ladders 19 may include vertical supports extending above end platform 20, and handrail 28 may extend horizontally between the vertical supports. In some embodiments, handrail 28 may include vertical supports coupled to end platform 20 or other structural components of railcar 10 and a horizontal portion extending between the vertical supports.

Handrail 28 provides a rail operator a place for three point contact when, for example, traversing end platform 20 or when stepping from end platform 20 to connecting platform 22. Thus, handrail 28 reduces a tripping hazard associated with navigating end platform 20.

Another advantage is that handrail 28 may close off areas outside of the walking area to prevent operators from leaving the walking area and falling off the car. For example, handrail 28 may discourage a rail operator from attempting to get on or off end platform 20 at any location except for at ladders 19 located on each side.

In particular embodiments, the various handrails are between 30 inches and 40 inches above their respective platforms.

FIG. 8 is a perspective schematic of one end of an example well car with multiple handrails, according to a particular embodiment. FIG. 8 illustrates the end of the well car illustrated in FIG. 7 with additional handrails 30 and 32.

In particular embodiments, handrails 30 provide a rail operator a place for three point contact when, for example, traversing end platform 20, when stepping from end platform 20 to connecting platform 22, when traversing connecting platform 22, or when traversing well platform 24. In particular embodiments, one end of handrail 30 is coupled to a handrail associated with ladder 19. Handrail 30 extends from ladder 19 along an inside edge of end platform 20. The inside edge of end platform 20 is the edge adjacent to an interior portion of the railcar.

In some embodiments, handrail 30 may extend from ladder 19 along an inside edge of end platform 20, along an edge of connecting platform 22 (e.g., an edge parallel to longitudinal axis 72), and along an inside edge of well platform 24. The inside edge of well platform 24 is the edge opposite well 14. Handrail 30 may include supports coupled to connecting platform 22, well platform 24, and/or other structural components of railcar 10.

In particular embodiments, handrail 32 provide a rail operator a place for three point contact when, for example, traversing well platform 24. In particular embodiments, handrail 32 may be coupled to well platform 24. Handrail 32 extends along an edge of well platform 24 adjacent to well 14. Handrail 32 may prevent a rail operator from accidentally falling into well 14 when well 14 is empty (i.e., well 14 is not carrying containers).

Handrails 28, 30 and 32 may discourage an operator from walking or climbing on particular portions of the end section of railcar 10 that are unsafe. For example, handrail 30 may discourage an operator from stepping off of connecting platform 22 and climbing on the support members or other equipment included on the end section (also referred to as an interior portion of the railcar).

The handrails at various areas around the walking surface of the railcar may include various openings in the handrails to facilitate access to parts of the railcar. For example, handrails may be installed at the coupler or articulated ends, for either standalone or articulated cars. When applied at articulated ends, openings are provided for crossing between cars. In particular embodiments, openings may be equipped with a chain, cable, rope, or any other suitable form of closure to temporarily prevent access between cars.

FIG. 9 is a perspective schematic of an articulated end of an example articulated well car with handrails, according to a particular embodiment. Articulated well cars share a common bogie/axle/truck, such as truck 12. The articulated well car includes truck 12, well 14, and walkways 26 similar to those described with respect to FIGS. 3 and 4.

The articulated well car also includes side platforms 40 and end platform 44. Side platforms 40 facilitate access to walkways 26 and/or end platform 44. For example, a rail operator may climb a ladder on the articulated end of the well car to access side platform 40. End platform 44 facilitates access to well 14 or containers in well 14.

In particular embodiments, the end of the articulated well car includes handrails 46 and 48. Handrails 46 may prevent a rail operator from falling onto truck 12. In particular embodiments, handrails 46 may include an opening between them, such as at the center of the railcar, to enable a rail operator to pass between handrails 46 to access an adjacent articulated well car. In particular embodiments, the opening may be equipped with a chain, cable, rope, or any other suitable form of closure to temporarily prevent access between cars.

In particular embodiments, handrail 48 extends along the well side of end platform 44. Handrail 48 may prevent a rail operator from falling into well 14, such as when well 14 is empty.

Although particular handrails have been illustrated on a particular well car, other embodiments may include well cars of all sizes and types. Particular embodiments provide improved ergonomics by providing operators an additional area to grab onto and allow personnel to maintain three points of contact when traversing a railcar.

On particular occasions, a rail operator may access an empty well of the well car. Because of the minimal clearance between the sides of the railcar to the ground and to the rail, a rail operator may only access the well interior by entering from the top. To improve accessibility, various steps have been used in various locations. Without anything for an operator to grab onto, however, egress from the well may be difficult.

Particular embodiments include a combination of step and handrail to facilitate easier egress from the well. Examples are illustrated in FIGS. 10A and 10B.

Figure 10A:
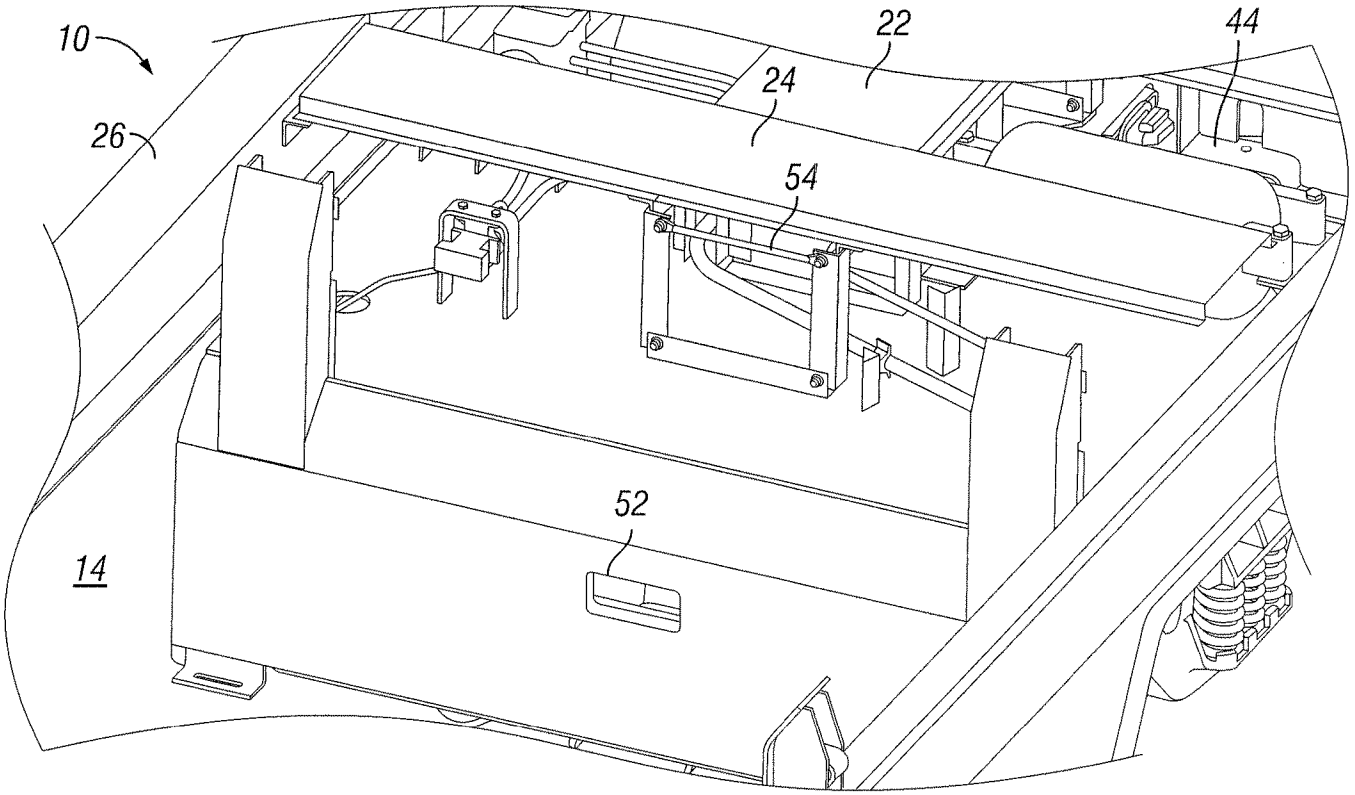
FIG. 10A is a perspective schematic of a well of an example well car with a step and handrail, according to a particular embodiment.
Figure 10B:
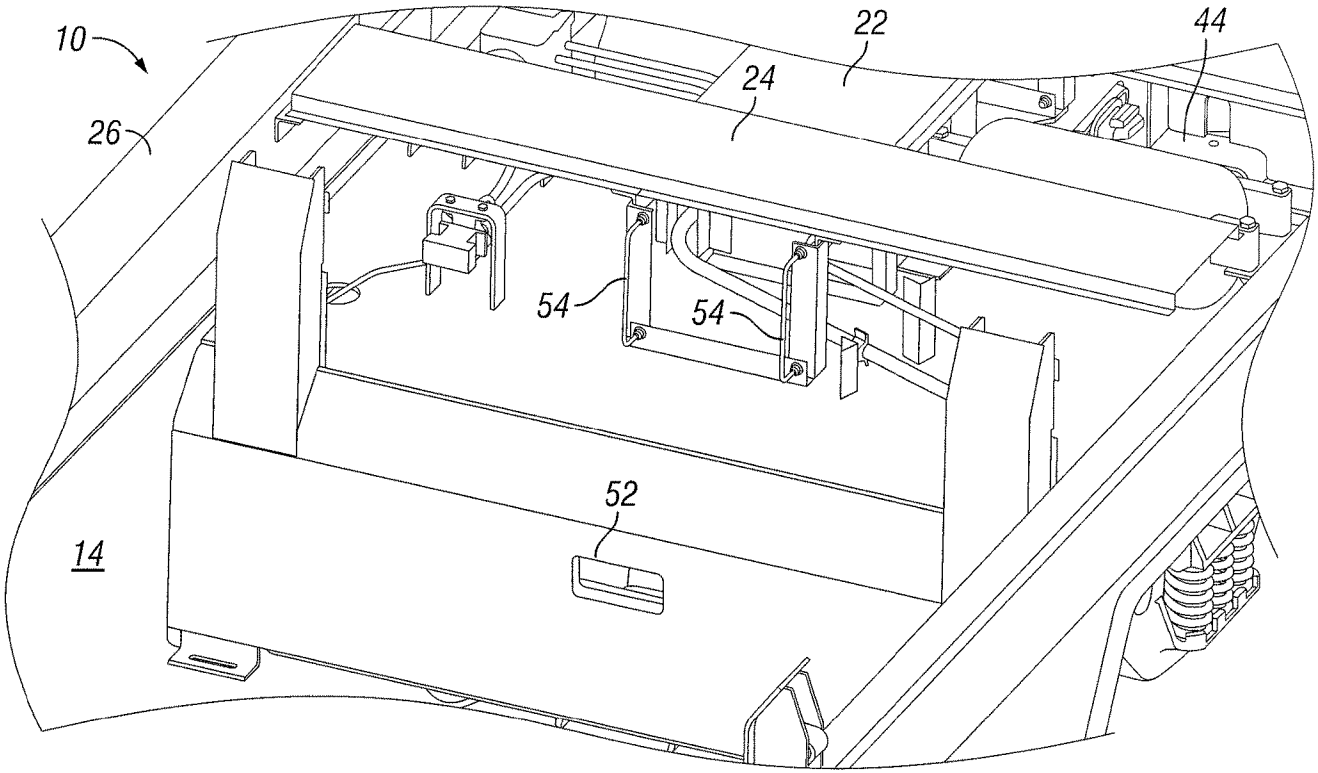
FIG. 10B is a perspective schematic of a well of an example well car with a step and another handrail, according to a particular embodiment.

FIG. 10A is a perspective schematic of a well of an example well car with a step and handrail, according to a particular embodiment. The example well car includes well 14, connecting platform 22, well platform 24, and running board 26 similar to those described with respect to FIGS. 3 and 4.

In particular embodiments, well 14 includes ladder step 52 and handrail 54. Ladder step 52 may be coupled to well platform 24 or recessed into an end of well 14. Ladder step 52 facilitates operator ingress and egress of well 14. For example, a rail operator may access well 14 from well platform 24 via ladder step 52. A rail operator may also exit well 14 via ladder step 52. To safely place a foot on ladder step 52, a rail operator may enjoy extra stability or support by placing one or both hands on a stable surface. Well platform 24 may be too high for the rail operator to hold onto. Thus, particular embodiments include a handrail.

For example, handrail 54 may be coupled to well platform 24 or any other suitable location on an end of well 14. Handrail 54 provides location for the rail operator to hold onto while placing a foot onto ladder step 52. Handrail 54 comprises a diameter suitable for gripping by hand. For example, handrail 54 may comprise metal round bar of between ¾ inch and 1 inch in diameter. Handrail 54 is located a height suitable for an operator to reach while standing in well 14. For example, handrail 54 may be located between 33 inches and 61 inches above the floor of well 14. In particular embodiments, handrail 54 may be integrated with ladder step 52, or may be mounted separately.

For example, an integrated handrail may comprise a ladder with two rungs. The bottom rung (e.g., ladder step 52) may be sized to accommodate an operator's foot and the top rung (e.g., handrail 54) may be sized to accommodate the operator's hand. As a particular example, the bottom rung and rails of the ladder may comprise angled bar and the top rung may comprise round bar.

In some embodiments, ladder step 52 may comprise a substantially flat surface. An advantage is that the substantially flat surface provides a stable surface for an operator to stand on. Handrail 54 may comprise a substantially rounded surface. An advantage is that the substantially rounded surface provides a comfortable grip for one or both of the operator's hands.

Although handrail 54 is illustrated with two vertical supports (e.g., U or D shape), other embodiments may include other configurations, such as one vertical support (e.g., an inverted T shape). In some embodiments, well 14 may comprise an end wall (or partial height end wall). Ladder step 52 may comprise a foothold recessed into an end wall of well 14. Handrail 54 may comprise a handrail coupled to the end wall of well 14 above the recessed foothold. Handrail 54 may comprise a single horizontally oriented handrails or one or more vertically oriented handrails.

In some embodiments, ladder step 52 may comprise a horizontal step coupled to two vertically oriented handrails 54 (i.e., a ladder with a single step where the sides or rails of the ladder are sized to comfortably accommodate an operator's hand). An example is illustrated in FIG. 10B.

FIG. 10B is a perspective schematic of a well of an example well car with a step and another handrail, according to a particular embodiment. The example well car includes well 14, connecting platform 22, well platform 24, walkway 26, and ladder step 52 similar to those described with respect to FIG. 10A.

In particular embodiments, well 14 includes a pair of vertical handrails 54. Pair of vertical handrails 54 may be coupled to well platform 24 or any other suitable location on an end of well 14. Vertical handrails 54 provide a location for the rail operator to hold onto while placing a foot onto ladder step 52. Vertical handrails 54 are located a height suitable for an operator to reach while standing in well 14. An advantage of vertical handrails 54 is that they may comfortably accommodate operators of varying height. In particular embodiments, vertical handrails 54 may be integrated with ladder step 52, or may be mounted separately.

A particular advantage of the step and handrail are that they provide improved operator egress from the well component of the railcar with a simple configuration and compact design that is out of the way of containers being loaded or unloaded in the well.

Railcars may include other types of ladders as well. For example, FIGS. 3 and 4 illustrate ladders 19 for accessing the end platforms of a well car. Other types of railcars may include ladders or steps for accessing various parts of the railcar. For example, tank cars and hopper cars may include end ladders that provide access to a top walkway or top platform.

Conventional safety appliances on railcars may include staggered steps with vertical handholds located beside them. Pairing vertical handholds with staggered steps, however, creates an uncomfortable access point for a rail operator. Particular embodiments include staggered steps with handholds that correspond to the staggering of the steps to improve its ergonomics and ease of use. In some embodiments, vertical handholds may be bent to follow the staggering of the steps. An example is illustrated in FIGS. 11A and 11B.

Figure 11B:
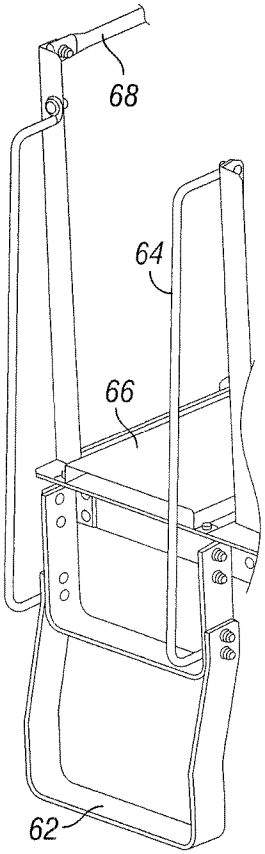
FIGS. 11A and 11B are an end and perspective schematic, respectively, of a staggered step and handrail, according to a particular embodiment.
Figure 11A:
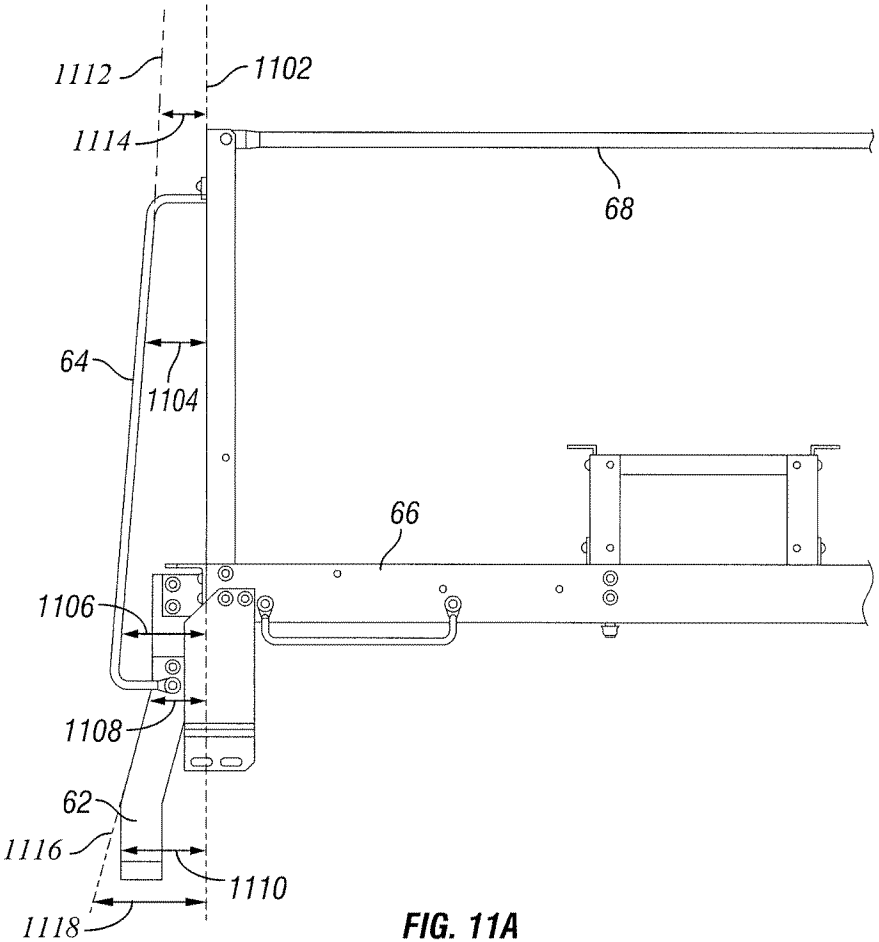

FIGS. 11A and 11B are an end and perspective schematic, respectively, of a staggered step and handrail, according to a particular embodiment. Ladder 62 extends in a generally vertical direction and provides access to platform 66. In the illustrated embodiment, ladder 62 extends below platform 66 towards the ground to provide access to platform 66.

Handrail 64 is oriented in a generally vertical direction and is associated with ladder 62. Handrail 64 (also referred to as a handhold) provides handheld support for a rail operator on ladder 62. Handrail 68 is associated with platform 66 and provides handheld support for a rail operator on platform 66.

Ladder 62 includes staggered steps or rungs. In some embodiments, ladder 62 may be referred to as a staggered ladder. For example, when ladder 62 is attached to a railcar, such as railcar 10, the bottom step of ladder 62 is offset from the body of the railcar by a greater distance than the top step of ladder 62. Locating the bottom step of ladder 62 farther away from the body of the railcar makes it easier for a rail operator to step between the ground, for example, and ladder 62. Locating the top step of ladder 62 closer to the body of the railcar makes it easier for a rail operator to step to or from platform 66.

A vertical handrail associated with a staggered ladder may be uncomfortable for a rail operator. The vertical handrail may be comfortable when the rail operator is on the top step or the bottom step (i.e., depending on how far the handrail extends from the railcar body), but is not comfortable at both positions. For example, when stepping from the ground to the bottom step of a staggered ladder, the rail operator may over-extend to reach a vertical handrail. If the vertical handrail is positioned farther away from the railcar body to be comfortable for the rail operator when stepping onto the ladder from the ground, then the vertical handrail may be positioned too far away from the railcar body to be comfortable when the operator is on the top step of the ladder.

A handrail that is staggered corresponding to a staggered ladder obviates the problems described above. For example, handrail 64 is angled to correspond to the stagger of ladder 62. In some embodiments, handrail 64 may be referred to as a staggered handrail. When handrail 64 is coupled to a railcar, such as railcar 10, a bottom portion of handrail 64 is offset from the railcar body by a greater distance than a top portion of handrail 64. The slope of handrail 64 generally corresponds to the slope of ladder 62.

The amount a step or handrail is offset from the body of the railcar may be described in terms of a vertical plane that coincides with a side or end of the railcar. The vertical plane extends from the ground upwards along a side or end of the railcar.

In the illustrated example, vertical plane 1102 represents a vertical plane that coincides with the end of the railcar. A bottom portion of handrail 64 is offset from vertical plane 1102 by horizontal distance 1106. A top portion of handrail 64 is offset from vertical plane 1102 by horizontal distance 1104. When horizontal distance 1104 is less than horizontal distance 1106, handrail 64 may be referred to as a staggered handrail. If a portion of handrail 64 extends above or below the body of the railcar, the distance between handrail 64 and the body of railcar refers to the horizontal distance between handrail 64 and vertical plane 1102.

In some embodiments, horizontal distance 1104 may be between 2 inches and 8 inches. Horizontal distance 1106 may be between 3 inches and 14 inches.

Similarly, a top step of ladder 62 is offset from vertical plane 1102 by horizontal distance 1108 and a top step of ladder 62 is offset from vertical plane 1102 by horizontal distance 1110. When horizontal distance 1108 is less than horizontal distance 1110, ladder 62 may be referred to as a staggered ladder. If a portion of ladder 62 extends above or below the body of the railcar, the distance between ladder 62 and the body of railcar refers to the horizontal distance between ladder 62 and vertical plane 1102.

In some embodiments, horizontal distance 1108 may be between 0 inches and 8 inches. Horizontal distance 1110 may be between 1 inch and 12 inches.

Some embodiments may be described by reference to a vertical axis of handrail 64 and ladder 62. Handrail 64 includes vertical axis 1112. Vertical axis 1112 is offset from vertical plane 1102 by an angle or degree 1114. In some embodiments, vertical axis 1112 may be angled at approximately 5 degrees in relation to vertical plane 1102.

Ladder 62 includes vertical axis 1116. Vertical axis 1116 is offset from vertical plane 1102 by an angle or degree 1118. In some embodiments, vertical axis 1116 may be angled at approximately 15 degrees in relation to vertical plane 1102.

As described above, the slope of handrail 64 generally corresponds to the slope of ladder 62. In some embodiments, ladder 62 and handrail 64 may be angled by the same degree (e.g., angle 114 is generally equal to angle 118) or have the same offsets from vertical plane 1102 (e.g., the difference between horizontal offsets 1104 and 1106 may be generally proportional to the difference between horizontal offsets 1108 and 110).

In other embodiments, the slope of handrail 64 may still correspond to the stagger of ladder 62 but handrail 64 may be angled by a different degree (e.g., angle 114 is not equal to angle 118) or have different offsets from vertical plane 1102 than ladder 62. The amount of offset may be constant (e.g., straight handrail at fixed angle) or vary (e.g., curved handrail). Thus, a rail operator may comfortably reach handrail 64 (e.g., the reach is generally the same) at any point along ladder 62. Angled vertical handholds create a more natural condition akin to a typical stairwell handrail. Conventional vertical handholds do not provide such benefits. Although a particular ladder and handrail configuration is illustrated in FIGS. 11A and 11B, particular embodiments may include any railcar with inboard and/or outboard side handholds.

The various handrails described above may be coupled to other components of a railcar via any coupling method suitable for the particular handrail. For example, in particular embodiments, handrails may be bolted or welded to other components of a railcar, such as platforms, ladders, reinforcing pads, etc.

Modifications, additions, or omissions may be made to the systems and apparatuses disclosed herein without departing from the scope of the invention. The components of the systems and apparatuses may be integrated or separated. Moreover, the operations of the systems and apparatuses may be performed by more, fewer, or other components.

Although embodiments of the present disclosure and their advantages have been described in detail, it should be understood that various changes, substitutions and alternations can be made herein without departing from the spirit and scope of the invention as defined by the following claims.

The invention claimed is:

1. A railcar comprising:
- a pair of trucks disposed near each end of the railcar;
- a well component supported by the pair of trucks and disposed between the pair of trucks, the well component comprising two parallel top chords;
- a pair of end sections supported by the pair of trucks and disposed at each end of the railcar;
- at least one end section comprising:
  - a pair of running boards, each running board of the pair of running boards disposed on one of the two parallel top chords of the well component;
  - a well platform disposed near an end of the well component at a first height generally even with the pair of running boards;
  - an end platform disposed near one end of the railcar at a second height, the second height lower than the first height;
  - a first inclined connecting platform extending between the end platform and the well platforms;
- wherein the well platform comprises:
  - an intermediate well platform at a third height, the third height lower than the first height;
  - two edge well platforms at the first height;
  - two inclined well platforms, each inclined well platform extending between one of the edge well platforms and the intermediate well platform; and
  - wherein the first inclined connecting platform extends between the end platform and the intermediate well platform.

2. The railcar of claim 1, wherein the first height is one inch or less different than the second height.

3. The railcar of claim 1, wherein the end platform comprises:
- an intermediate end platform at the second height;
- two edge end platforms at a fourth height, the fourth height lower than the second height;
- two inclined end platforms, each inclined end platform extending between one of the edge end platforms and the intermediate end platform; and
- wherein the first inclined connecting platform extends between the intermediate end platform and the well platform.

4. The railcar of claim 1, further comprising a second inclined connecting platform extending between the end platform and the well platform.

5. The railcar of claim 1, further comprising a ladder coupled to the end platform.

6. A railcar end section, comprising:
- a first platform disposed at a first height for providing operator access to a portion of the railcar, the first platform oriented to facilitate operator movement in a transverse direction across the railcar;
- a second platform disposed at a second height, the second height different than the first height, the second platform oriented to facilitate operator movement in a transverse direction across the railcar;
- a first inclined connecting platform extending between the first platform and the second platform, the inclined platform oriented to facilitate operator movement in a longitudinal direction along the railcar;

wherein the first platform comprises:

a first intermediate platform at a third height, the third height lower than the first height;

two first edge platforms at the first height;

two first inclined platforms, each first inclined platform extending between one of the first edge platforms and the first intermediate platform; and wherein the first inclined connecting platform extends between the first intermediate platform and the second platform.

7. The railcar end section of claim 6, wherein the first height is one inch or less different than the second height.

8. The railcar end section of claim 6, wherein the second platform comprises:

a second intermediate platform at the second height;

two second edge platforms at a fourth height, the fourth height lower than the second height;

two second inclined platforms, each second inclined platform extending between one of the second edge platforms and the second intermediate platform; and wherein the first inclined connecting platform extends between the first platform and the second intermediate platform.

9. The railcar end section of claim 6, further comprising a second inclined connecting platform extending between the first platform and the second platform.

10. The railcar end section of claim 6, further comprising a ladder coupled to the second platform.

11. The railcar end section of claim 6, wherein the railcar comprises a well car and the first platform provides operator access to a well component of the well car.

12. A platform system for use with a railcar, the platform system comprising:

a first platform disposed at a first height for providing operator access to a portion of a railcar;

a second platform oriented generally parallel to the first platform and disposed at a second height, the second height different than the first height;

a first inclined connecting platform extending between the first platform and the second platform, the inclined platform oriented to facilitate operator movement between the first platform and the second platform;

wherein the first platform comprises:

a first intermediate platform at a third height, the third height lower than the first height;

two first edge platforms at the first height;

two first inclined platforms, each first inclined platform extending between one of the first edge platforms and the first intermediate platform; and wherein the first inclined connecting platform extends between the first intermediate platform and the second platform.

13. The platform system of claim 12, wherein the first height is one inch or less different than the second height.

14. The platform system of claim 12, wherein the second platform comprises:

a second intermediate platform at the second height;

two second edge platforms at a fourth height, the fourth height lower than the second height;

two second inclined platforms, each second inclined platform extending between one of the second edge platforms and the second intermediate platform; and wherein the first inclined connecting platform extends between the first platform and the second intermediate platform.

15. The platform system of claim 12, further comprising a second inclined connecting platform extending between the first platform and the second platform.

16. The platform system of claim 12, wherein the railcar comprises a well car and the first platform provides operator access to a well component of the well car.

17. The platform system of claim 16, wherein the second platform provides operator access to the well car.

* * * * *